United States Patent [19]

Tardy

[11] 4,093,002

[45] June 6, 1978

[54] CONTROL DEVICE OF A LARGE HYDRAULIC DISTRIBUTOR, IN PARTICULAR FOR PUBLIC WORKS APPLIANCES

[75] Inventor: Maurice Tardy, Saint Etienne, France

[73] Assignee: Bennes Marrel, Andrezieux Boutheon, France

[21] Appl. No.: 691,649

[22] Filed: Jun. 1, 1976

[30] Foreign Application Priority Data

May 29, 1975 France ..... 75 17503

[51] Int. Cl.[2] ..... F15B 11/08; F15B 13/042

[52] U.S. Cl. ..... 137/596.2; 91/445; 91/447

[58] Field of Search ..... 91/445, 447; 137/596.14, 596.15, 596.16, 596.2

[56] References Cited

U.S. PATENT DOCUMENTS

| | | | |
|---|---|---|---|
| 3,805,678 | 4/1974 | Bianchetta | 91/447 |
| 3,972,267 | 8/1976 | Haak | 91/447 X |
| 4,000,683 | 1/1977 | Schexnayder | 91/447 X |

*Primary Examiner*—Robert G. Nilson

*Attorney, Agent, or Firm*—Remy J. VanOphem

[57] ABSTRACT

The present invention relates to a control device for a controlled non-return valve provided in large hydraulic distributors. During the mode of operation where the double acting hydraulic ram is in a non-movable state, a means is utilized to communicate a control pressure to the one-way non-return check valve to positively maintain the check valve in a closed state thereby eliminating the accidental opening of the return valve and maintaining the double acting hydraulic ram in its initial position.

6 Claims, 8 Drawing Figures

CONTROL DEVICE OF A LARGE HYDRAULIC DISTRIBUTOR, IN PARTICULAR FOR PUBLIC WORKS APPLIANCES

BACKGROUND OF THE INVENTION

The present invention relates to a control device for a controlled pressure responsive valve means provided in a directional control valve, in particular for public works appliances.

A control valve of this type is intended to operate a double-acting hydraulic ram for example, whereas the circulation of the fluid may take place at a rate of flow of 500 litres per minute at pressures reaching 400 bars. The control valve itself comprises at least one slide valve or spool sliding in a valve housing having two outlets or utilisation points and an inlet, said outlets communicating with first and second pressure chambers respectively for example one to the main as well as a connection for the inlet to communicate with a supply of fluid under pressure. Pressure responsive valve means is interposed said outlets opposing the return of the fluid to the directional control valve when the latter is inoperative. An automatic control system opens the valve means allowing communication with one outlet as soon as fluid under pressure is communicated through the other outlet.

The known control system comprises certain drawbacks. Thus, when the spool of the directional control valve passes quickly from one extreme position to the other, pressure responsive valve means is controlled inopportunely. These inopportune control actions have been able to be eliminated owing to the use of intersecting pipework between the two chambers for controlling the spool of the directional control valve. This results in a bulky arrangement and difficult construction.

The object of the present invention is to provide a control device for a directional control valve of a new type which prevents inopportune control actions whilst being of simple construction and less expensive to construct.

SUMMARY OF THE INVENTION

This invention provides a control device for a hydraulic directional control valve that positively maintains a double acting hydraulic ram in position during nonoperational modes of the hydraulic ram.

The invention is a directional control valve comprising a housing having an inlet and an outlet and pressure responsive spool means movable within said housing between a first position allowing communication from the inlet to the outlet, and a second position terminating communication between the inlet and the outlet. Further, pressure responsive valve means are disposed within the outlet dividing the outlet into a first and second pressure chamber, said pressure responsive valve means being normally biased to prevent fluid communication between said first and second pressure chambers when the spool means is in the second position, also said valve opening in response to a predetermined pressure in either of said pressure chambers when said spool means is not in said second position. The housing further defines a third pressure chamber which is adapted to communicate with a pilot valve means. The pilot valve means communicates a control pressure to said spool means to move said spool means to said first position and the pilot valve means further communicates said second pressure chamber to said third pressure chamber when said spool means is in said second position. A second valve means responsive to pressure in said third pressure chamber closes communication between said first and second pressure chambers when said spool means is in said second position.

Accordingly, it is an object of this invention to provide a directional control valve with internal control means able to positively prevent discharge of the internal pressure responsive valve means during modes of operation where the double acting hydraulic ram is in a non-operative state.

It is another object of this invention to provide a directional control valve that eliminates the inopportune opening of the pressure responsive valve means.

It is a still further object of this invention to provide a directional control valve with internal control means eliminating the inopportune opening of the pressure responsive return valve means which is of simple construction and inexpensive to manufacture.

The above and other objects and features of the invention will become apparent from the following detailed description taken in conjunction with the accompanying drawings and claims which form a part of this specification. Further, the use of numerals is for the purpose of clarification and is not intended to limit the specific embodiment reference.

BRIEF DESCRIPTION OF THE DRAWINGS

The accompanying drawings, given as a non-limiting example, will make it easier to understand the features of the invention.

DETAILED DESCRIPTION OF THE DRAWINGS

Figure 1:
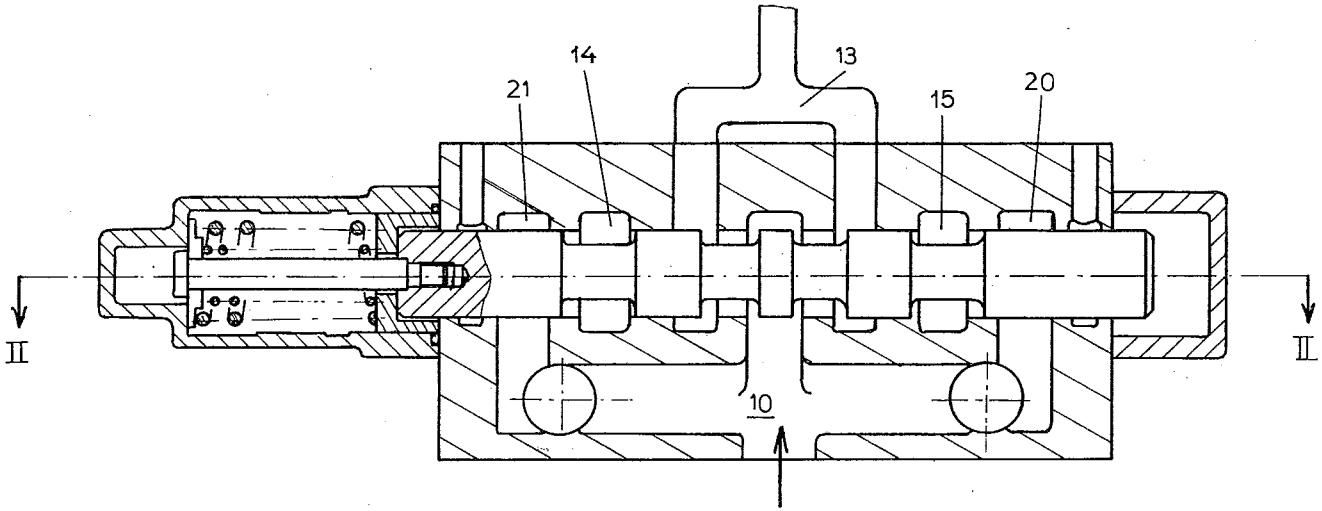
FIG. 1 is a horizontal section I—I (FIG..2) of a directional control valve provided with a control device according to the invention.
Figure 2:
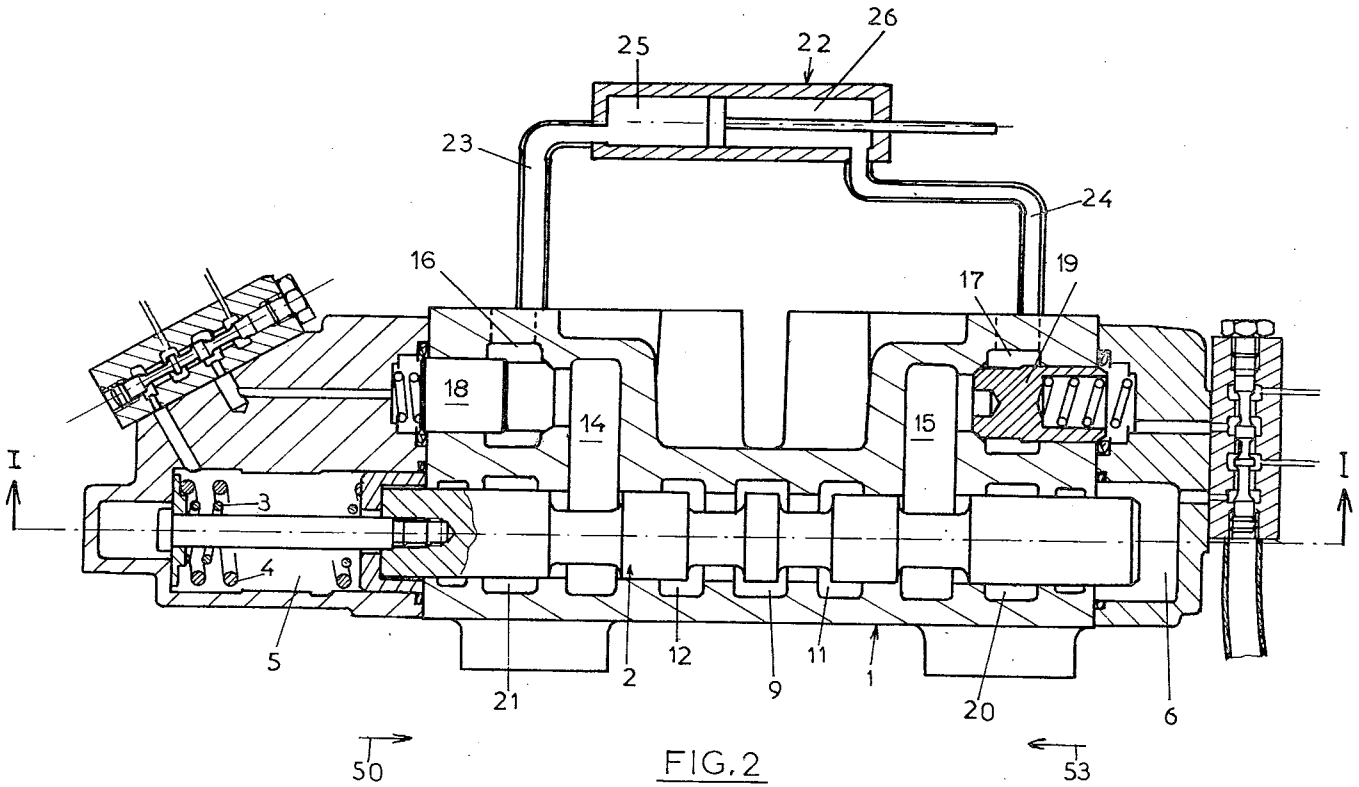
FIG. 2 is a section II—II (FIG. 1).

Referring now to the drawings FIGS. 1 and 2 show a directional control valve comprising a body, or housing sliding in which is a main slide valve or spool valve 2, retained in the central position by two springs 3 and 4 housed in a control chamber 5 located at one end of the slide valve 2 and constituting one of two control chambers for the slide valve 2. A second control chamber 6 is located at the other end of the slide valve.

The chambers of the power circuit of the slide or spool valve 2 are symmetrical with respect to the center of the directional control valve and are distributed in the following manner, starting from the center.

A central chamber or port 9 is connected to a pipe 10 for the supply of fluid under pressure. Then two symmetrical chambers or ports 11 and 12 are connected to the same pipe 13 for the return of fluid to the reservoir. The first pressure chambers or ports 14 and 15, constitute a utilisation point or outlet of the directional control valve and they are respectively connected to a second outlet or pressure chambers or ports 16 and 17 respectively by means of non-return one way check valves 18 and 19. The following chambers or ports 20 and 21 are connected to the supply 10.

The second pressure chambers 16 and 17 are respectively connected to a ram 22 through the intermediary of pipes 23 and 24. The pipe 23 opens into the main chamber 25 of this ram, whereas the pipe 24 opens into its annular chamber 26.

Figure 3:
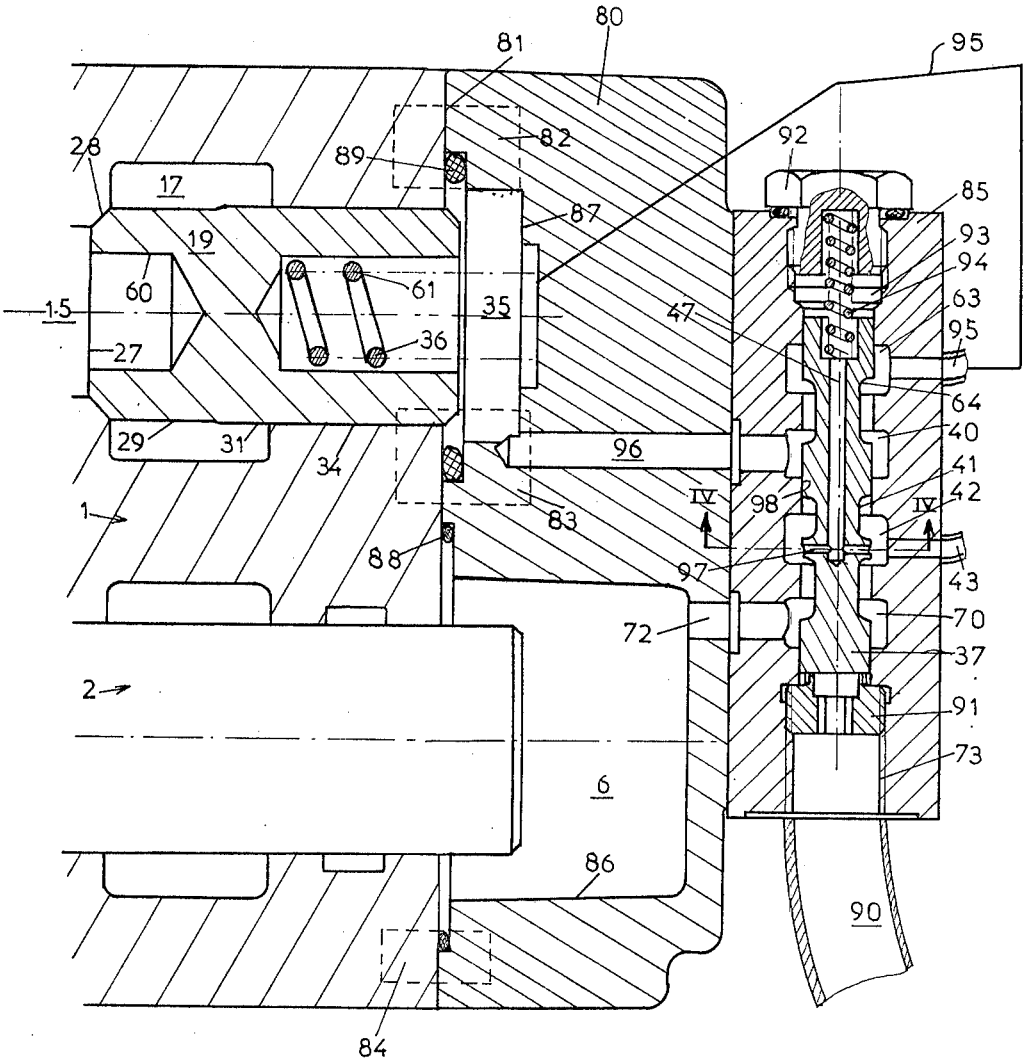
FIG. 3 is a partial view of FIG. 2, to an enlarged scale, showing the detail of the control device or pilot valve adjacent the control chamber of one of the ends of the main slide valve.
Figure 5:
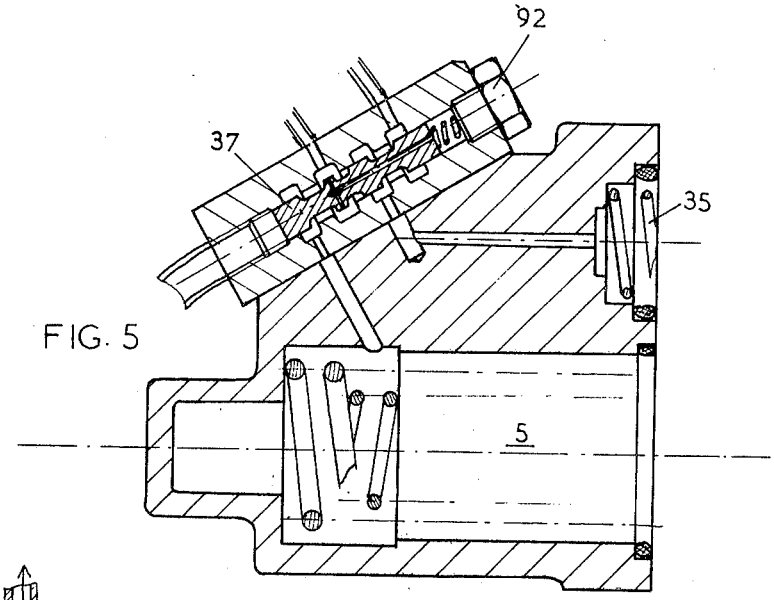
FIG. 5 is a partial view of FIG. 2, to an enlarged scale, showing the detail of the control device or pilot valve adjacent the opposite control chamber.

The non-return one way check valve 19 and its control device or pilot valve will now be described with particular reference to the detailed view of FIG. 3.

The non-return valve 19 comprises an obturating end 27 able to bear against the seat 28 separating the first and second chambers 15 and 17. Starting from this end, it comprises externally, a first cylindrical surface 29 followed by a second cylindrical surface 31, whose diameter is slightly greater than that of the surface 29. Internally, it comprises a blind axial hole 60 opening into the center of the obturating end 27 and a blind axial hole 61 opening into the center of the opposite end. The surface 31 slides in a bore 34 in the body 1.

A cap 80 is integral with the corresponding end of the body 1, with which it forms an interface 81 at right-angles to the axis of the slide or spool valve 2. Centering of the cap 80 on the body 1 is ensured by lugs 82, 83 and 84. On its end opposite the interface 81, the cap is in turn integral with the support 85 constituting the body of a pilot valve provided with a second slide or spool valve 37, whose sliding axis is arranged at right angles to the axis of the slide or main spool valve 2.

The cap 80 also comprises recesses 86 and 87 which define the control chamber 6 and a third pressure chamber 35 respectively, the latter opening in facing relationship to the end of the valve 19 opposite the obturating end. The seal of these two chambers is ensured in the region of the interface 81 by annular gaskets 88 and 89. A helical spring 36 is supported between the base of the hole 61 and the base of the recess 87.

At one of its axial ends, the pilot valve body 85 comprises a threaded hole 73, adjoining which is the pipe 90 of the circuit for controlling the main slide valve 2 intended to supply the control chamber 6. A ring 91 is locked at the bottom of this hole. At its other end, the body 85 comprises an obturating stopper 92 defining a chamber 93 with one of the ends of the second slide or spool valve 37, a helical spring 94 being compressed between the second slide valve 37 and the stopper 92 for drawing back said slide valve 37 at the beginning of its travel, i.e. into a position in which its opposite end closes off the pipe 90 by resting on the ring 91 which fulfills the function of a valve seat.

The pilot valve body 85 also comprises four grooves which will be considered in order starting from the end provided with the stopper 92. The first groove 63 is connected to the second pressure chamber 17 by a pipe 95 which is partly shown. The second groove 40 is connected to the third pressure chamber 35 by means of a hole 96 which passes simultaneously through the cap 80 and the body 85. The third groove 42 is connected to a pipe 43 for the return of fluid to the reservoir. Finally, the fourth groove 70 communicates with the control chamber 6 through the intermediary of a hole 72 which passes simultaneously through the cap 80 and support 85.

The pilot valve spool 37 comprises a first groove 64 able to facilitate connection between the grooves 40 and 63 and a second groove 41 facilitating either connection between the grooves 42 and 70, or connection between the grooves 40 and 42. The spool valve 37 also comprises a blind axial hole 47 opening into the chamber 93 and two radial holes 97 connect the hole 47 to the lateral surface of the spool valve 37, at the center of the bosses 197 located towards the center of the groove 41.

Figure 4:
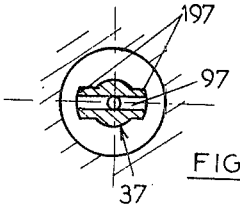
FIG. 4 is a section IV—IV (FIG. 3).

The system for controlling the non-return valve 18 is substantially identical to that of the non-return valve 19, only the orientation of the axis of the pilot valve is different (FIG. 4).

OPERATION

Figure 6:
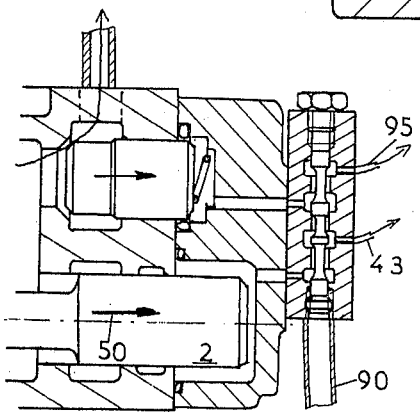
FIGS. 6 to 8 are identical views to those of FIG. 3, but on a smaller scale and showing the various stages of operation.
Figure 7:
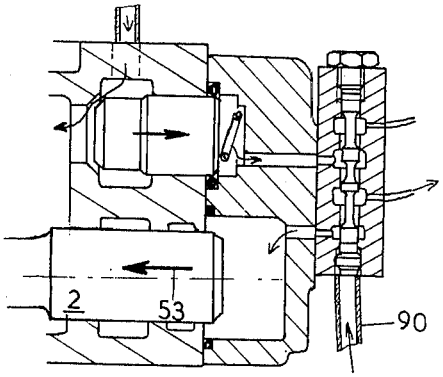
Figure 8:
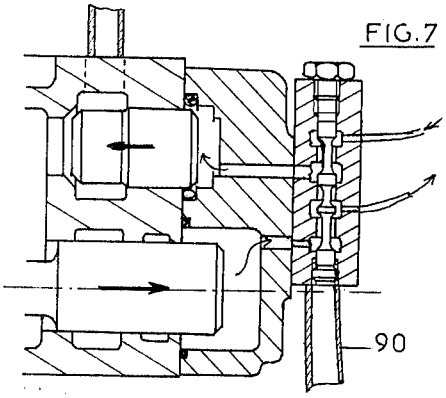

Referring to FIGS. 6 through 8, the operation is as follows. When the control chamber 5 is under pressure, the slide or spool valve 2 moves in the direction 50 (FIG. 6). The chamber 20 is thus connected to the chamber 15 by supplying it with fluid under pressure, which pushes the non-return valve 19 against the return force of the spring 36 and against the pressure in the third chamber 35. Since no pressure has been established in the pipe 90, the pilot spool valve 37 is inoperative and the connection of the grooves 40 and 63 allows the third chamber 35 to empty through the pipe 95. The fluid contained in the control chamber 6 is emptied simultaneously into the reservoir by means of the connection of the chambers 70 and 42. The fluid fills the annular chamber 26 of the ram 22, whose chamber main 25 should empty due to opening of the non-return valve 19. Since the arrangements are the same for the both non-return check valves 18 and 19, opening of the valve 18 takes place in the same way as opening of the valve 19, when the control pressure of the main spool valve 2 is sent into the control chamber 6.

When the control pressure is sent through the pipe 90, this pressure displaces the pilot valve spool 37 axially until it establishes a connection between this pipe 90 and the groove 70, to enable fluid to fill the control chamber 6 (FIG. 7). Simultaneously, the pilot valve spool 37 isolates the groove 70 from the groove 42, as well as the groove 40 from the groove 63, but it connects the grooves 40 and 42. The third pressure chamber 35 is thus open to the reservoir and its pressure drops. During this time, the pressure in the control chamber 6 displaces the main valve spool 2 in the direction 53, such that the fluid is sent from the chamber 21 to the first pressure chamber 14, then to the main chamber 25 of the ram. The pressure in the second pressure chamber 17 is exerted on a limited annular surface between the two diameters of the cylindrical surfaces 29 and 34 to push the non-return valve 19, by compressing the sprig 36. If the pilot slide valve 37 arrives in the vicinity of the end of its axial travel, the radial holes 97 are thus covered by the bore 98 which separates the grooves 40 and 42, which completely isolates the chamber 93, whose pressure prevents any additional movement of the pilot valve spool. This arrangement prevents impact between the slide valve 37 and stopper 92.

When the pipe 90 is no longer under pressure, the pilot valve spool 37 returns to the inoperative position and the third pressure chamber 35 is filled by means of the pipe 95, to facilitate closure of the non-return valve 19 (FIG. 8).

It will be seen that even in the case of sudden movements of the main spool valve 2, inopportune opening of the pilot valve spool 37 is prevented since if the control chamber 6 empties through the pipe 43 and the grooves 42 and 47, this results in a rise in pressure in this chamber 42, which is transmitted to the chamber 93 by the radial holes 97, to keep the pilot valve spool 37 pressed firmly against the ring 91.

While a preferred embodiment of the invention has been disclosed, it will be apparent to those skilled in the art that changes may be made to the invention as set forth in the appended claims and, in some instances, certain features of the invention may be used to advantage without corresponding use of other features. Accordingly, it is intended that the illustrative and descriptive materials herein be used to illustrate the principles of the invention, and not to limit the scope thereof.

Having described the invention, what is claimed is:

1. A directional control valve comprising:

a. housing having an inlet and an outlet;

a pressure responsive spool means disposed in said housing, said spool means being movable between a first position for communicating said inlet to said outlet and a second position terminating communications between said inlet and said outlet said spool means having a pressure chamber which when communicated to pressure is operative to shift said spool means to said second position;

a reservoir port;

a pressure responsive valve means disposed in said outlet dividing said outlet into first and second pressure chambers, said valve means being normally biased to prevent fluid communication between said pressure chambers when said spool means is in said second position, said valve means further adapted to open in response to a predetermined pressure in said first pressure chamber when said spool means is in said first position and said valve means is adapted to open in response to a predetermined pressure in said second pressure chamber when said spool means is in said first position;

a third pressure chamber disposed within said housing adjacent said pressure responsive valve means;

pilot valve means operable upon activation for communicating a control pressure to said spool means to move said spool means to said second position, said pilot valve means further adapted to communicate said second pressure chamber to said third pressure chamber when said spool means is in said second position; and said pilot valve means closing communcation between said second and third pressure chambers when said spool means is in said second position and said pilot valve means connecting said third pressure chamber to said reservoir port, said pilot valve means having a pressure port which when communicated to pressure is operable to actuate said pilot valve means, said spool means chamber and said pressure port being connected in series by said pilot valve means.

2. The directional control valve as claimed in claim 1 wherein the pressure responsive valve means further comprises:

a non-return one-way annular check valve mounted in said outlet, said check valve having a first end portion terminating in a valve seat and an opposite end portion terminating in said third pressure chamber, said first end portion having an outside diameter smaller than the outside diameter of said opposite end portion.

3. The directional control valve as claimed in claim 2 wherein said pilot valve means further comprises:

a pilot valve housing having a central passage, one end portion of said central passage having inlet means for receiving a controlled fluid supply under pressure and an opposite end portion terminating in a cavity defining a fourth pressure responsive chamber, said central passage further comprises:

a first passage adjacent but spaced away from said inlet means, said first passage having means for communicating with said pressure responsive spool means;

a second passage adjacent but spaced away from said fourth pressure responsive chamber, said second passage having means for communicating with said second pressure chamber;

a third passage interposed said first and second passages, said third passage having means for communicating with said third pressure chamber of said housing, said third passage further having second means for communicating with said second passage; and a fourth passage interposed said third and first passages, and passage means for communicating said fourth passage with said first passage, said third passage, and said fourth chamber, means for biasing disposed within said fourth pressure responsive chamber; and a pressure responsive pilot valve spool means mounted within said central passage of said pilot valve housing, said pilot valve spool means being moveable between a first position for communicating said inlet means to said spool means and a second position terminating communication between said inlet means and said pressure responsive spool means, said pilot valve spool means further comprising; a pilot valve body having one end portion defining a valve adapted to communicate with said inlet means or said pilot valve housing when said pilot valve spool is in a second position, said one end portion further having means for terminating communication between said first passage and said fourth passage, when said pilot valve spool is in the first position; said pilot valve body further having an opposite end portion adapted to receive said biasing means, said opposite end portion further adapted to terminate communication between said second and third passages when said pilot valve spool is in a first position.

4. The directional control valve as claimed in claim 3 wherein the means for communicating said fourth passage with said first and third passages, said fourth chamber and said fluid supply further comprises:

means for terminating communication between said fourth passage and said fourth chamber when said pilot valve body is in a first position and second means for terminating communication between said fourth and third passages when said pilot valve body is in a first and second position.

5. The directional control valve as claimed in claim 1 wherein said pilot valve means further comprises:

a pilot valve housing having a central passage, one end portion of said central passage having inlet means for receiving a controlled fluid supply under pressure and an opposite end portion terminating in a cavity defining a fourth pressure responsive chamber, said central passage further comprising:

a first passage adjacent but spaced away from said inlet means, said first passage having means for communicating with said pressure responsive spool means;

a second passage adjacent but spaced away from said fourth pressure responsive chamber, said second passage having means for communicating with said second pressure chamber;

a third passage interposed said first and second passages, said third passage having means for communicating with said third pressure chamber of said housing, said third passage further having second means for communicating with said second passage; and a fourth passage interposed said third and first passages, and passage means for communicating said fourth passage with said first passage, said third passage, and said fourth chamber;

means for biasing disposed within said fourth pressure responsive chamber; and a pressure responsive pilot valve spool means mounted within said central passage of said pilot valve housing, said pilot valve spool means being movable between a first position for communicating said inlet means to said spool means and a second position terminating communication between said inlet means and said pressure responsive spool means, said pilot valve spool means further comprising; a pilot valve body having one end portion defining a valve adapted to communicate with said inlet means of said pilot valve housing when said pilot valve spool is in a second position, said one end portion further having means for terminating communication between said first passage and said fourth passage, when said pilot valve spool is in the first position; said pilot valve body further haiving an opposite end portion adapted to receive said biasing means, said opposite end portion further adapted to terminate communication between said second and third passages when said pilot valve spool is in a first position.

6. The directional control valve as claimed in claim 5 wherein the means for communicating said fourth passage with said first and third passages, said fourth chamber and said fluid supply further comprises:

means for terminating communication between said fourth passage and said fourth chamber when said pilot valve body is in a first position and second means for terminating communication between said fourth and third passages when said pilot valve body is in a first and second position.

* * * * *

UNITED STATES PATENT AND TRADEMARK OFFICE

CERTIFICATE OF CORRECTION

PATENT NO. : 4,093,002
DATED : June 6, 1978
INVENTOR(S) : Maurice Tardy

It is certified that error appears in the above-identified patent and that said Letters Patent are hereby corrected as shown below:

Column 1, line 20, delete "for example one to the main".

Column 4, line 8, after the word "non-return" insert the words ----one way----.

Column 4, line 30, delete the numeral "19" and insert ----18----.

Column 4, line 52, delete "sprig" and insert therefore ----spring----.

Column 6, line 24, delete the comma, second occurence, and insert a semicolon.

Column 8, line 9, delete "haiving" and insert therefore ----having----.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*